US006615617B1

(12) United States Patent
Lonati et al.

(10) Patent No.: US 6,615,617 B1
(45) Date of Patent: Sep. 9, 2003

(54) METHOD FOR PRODUCING A TUBULAR KNITTED ARTICLE, PARTICULARLY A HOSIERY ARTICLE, CLOSED AT ONE END, WITHOUT A SEAM, WITH A CIRCULAR MACHINE

(75) Inventors: Ettore Lonati, Brescia (IT); Fausto Lonati, Brescia (IT); Tiberio Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 10/364,621

(22) Filed: Feb. 12, 2003

(30) Foreign Application Priority Data

Feb. 22, 2002 (IT) ..... MI202A365

(51) Int. Cl.[7] ..... D04B 9/56
(52) U.S. Cl. ..... 66/148; 66/147; 66/179
(58) Field of Search ..... 66/147, 148, 149.5, 66/151, 8, 13, 184, 185, 186, 187, 58, 21, 22, 18

(56) References Cited

U.S. PATENT DOCUMENTS 5,606,876 A * 3/1997 Sangiacomo ..... 66/148
5,617,744 A * 4/1997 Conti ..... 66/148
6,044,668 A * 4/2000 Conti ..... 66/148
6,286,342 B1 * 9/2001 Truffelli et al. ..... 66/148
6,381,991 B2 * 5/2002 Ando' ..... 66/58

* cited by examiner

*Primary Examiner*—Danny Worrell
(74) *Attorney, Agent, or Firm*—Guido Modiano; Albert Josif; Daniel O'Byrne

(57) ABSTRACT

A method for producing a closed end hosiery seamless knitted article, on a circular machine, comprising: knitting of the article starting from the end to be closed, forming a knot for retaining a closure thread by way of a set of contiguous needles, weaving the closure thread and feeding it to a preset number of needles to connect needles arranged opposite with respect to a central plane passing through the needle cylinder axis and through a central region of the set of contiguous needles, interrupting feeding the closure thread to the needles forming a few rows of knitting by using other threads and at least part of the needles of the machine, applying traction to the closure thread to close the initial end of the article, and continuing production of the article to completion.

15 Claims, 15 Drawing Sheets

METHOD FOR PRODUCING A TUBULAR KNITTED ARTICLE, PARTICULARLY A HOSIERY ARTICLE, CLOSED AT ONE END, WITHOUT A SEAM, WITH A CIRCULAR MACHINE

BACKGROUND OF THE INVENTION

The present invention relates to a method for producing a tubular knitted article, particularly a hosiery article, closed at one end, without a seam, with a circular machine.

As is known, tubular articles, particularly hosiery articles, according to conventional production methods are generally manufactured by using circular machines and have both ends open when they are unloaded from the machine that forms them. Such articles must therefore undergo subsequent sewing or looping, which closes one end thereof, constituted by the toe for hosiery articles, in order to obtain the finished product.

Since this operation of closing one end of the article is an additional production step that requires time and the use of labor, with the associated costs, methods aimed at closing one end of the article directly on the manufacturing machine, or aimed at automating the transfer of the article from the production machine to a looping or sewing machine, so as to achieve a reduction in the overall production costs of the articles, have been devised and optimized in recent years.

These methods are generally used with satisfactory results on low-gauge articles.

In the field of production of high-gauge articles, such as for example women's stockings, a method is known which is disclosed in Italian patent no. 832,312 and allows to produce, with a circular hosiery knitting machine, tubular articles, particularly hosiery articles, which are closed at one end without a seam. The method consists in inserting, in the production of the end portion meant to be closed of each article, a closure thread, looping it for a first portion, weaving it in for a few turns or portions of turn of the needle cylinder of the machine and then looping it again in the end portion. This thread is then pulled so as to gather the loops with which it has been woven into a very small circle, which closes the affected end of the article, and is then fixed in order to keep the article closed.

Although this method allows to obtain tubular articles, particularly hosiery articles, including high-gauge articles, which are closed at one end, it has the drawback that it produces articles that have, at the loops gathered to close the article, wrinkles which in the case of hosiery articles can be uncomfortable for the user and can produce an article that is not fully satisfactory from an aesthetic standpoint.

SUMMARY OF THE INVENTION

The aim of the present invention is to solve the problem noted above, by providing a method that allows to produce, with a circular machine, a tubular knitted article, particularly a hosiery article, which is closed at one end and is fully satisfactory as regards comfort and the aesthetic aspect.

Within the scope of this aim, an object of the invention is to provide a method that allows to produce a tubular knitted article, particularly a hosiery article, including high-gauge articles, which is closed at one end directly during its manufacture and therefore does not require subsequent sewing operations to obtain the finished product.

Another object of the invention is to provide a method that can be performed with currently commercially available circular hosiery knitting machines on the basis of a preset program for the actuation of the machine.

This aim and these and other objects that will become better apparent hereinafter are achieved by a.method for producing a tubular knitted article, particularly a hosiery article, which is closed at one end, without a seam, with a circular machine, characterized in that it comprises:

- a first step, in which the knitting of the article is started from the end to be closed, forming a knot for retaining a closure thread by means of a set of contiguous needles;
- a second step, in which said closure thread is included in the weave, feeding it to a preset number of needles so that it mutually connects needles that are arranged opposite with respect to an imaginary central plane that passes through the axis of the needle cylinder of the machine and through a central region of said set of contiguous needles;
- a third step, in which the feeding of said closure thread to the needles of the machine is interrupted;
- a fourth step, in which a few rows of knitting are formed by using another thread or threads and at least part of the needles of the machine;
- a fifth step, in which traction is applied to said closure thread in order to close the initial end of the article;
- a sixth step, in which the production of the article is completed.

BRIEF DESCRIPTION OF THE DRAWINGS

Further characteristics and advantages of the invention will become better apparent from the description of a preferred but not exclusive embodiment of the method according to the invention, illustrated only by way of non-limitative example in the accompanying drawings, wherein.

The method according to the invention can be performed preferably with a single-cylinder circular hosiery knitting machine of the type currently commercially available that allows needle-by-needle electronic selection.

DESCRIPTION OF THE PREFERRED EMBODIMENTS

With reference to the figures, the method according to the invention comprises a first step, shown in FIGS. 1 to 5, in which the knitting of the article 1 begins starting from the end of said article that is to be closed and by forming a knot 2 for retaining a closure thread 3 by means of a set of contiguous needles.

In a second step, shown in FIGS. 6 to 11, the closure thread 3 is included in the weave, feeding it to a preset number of needles so that it mutually connects needles that are mutually opposite with respect to an imaginary central plane that passes through the axis of the needle cylinder 4 of the machine and through a central region of the set of contiguous needles used to form the retention knot 2.

In a third step, the feeding of the closure thread 3 to the needles of the machine is interrupted.

In a fourth step, shown in FIGS. 12 to 17, a few rows of knitting are formed by using another thread or threads and at least part of the needles of the machine.

Figure 18:
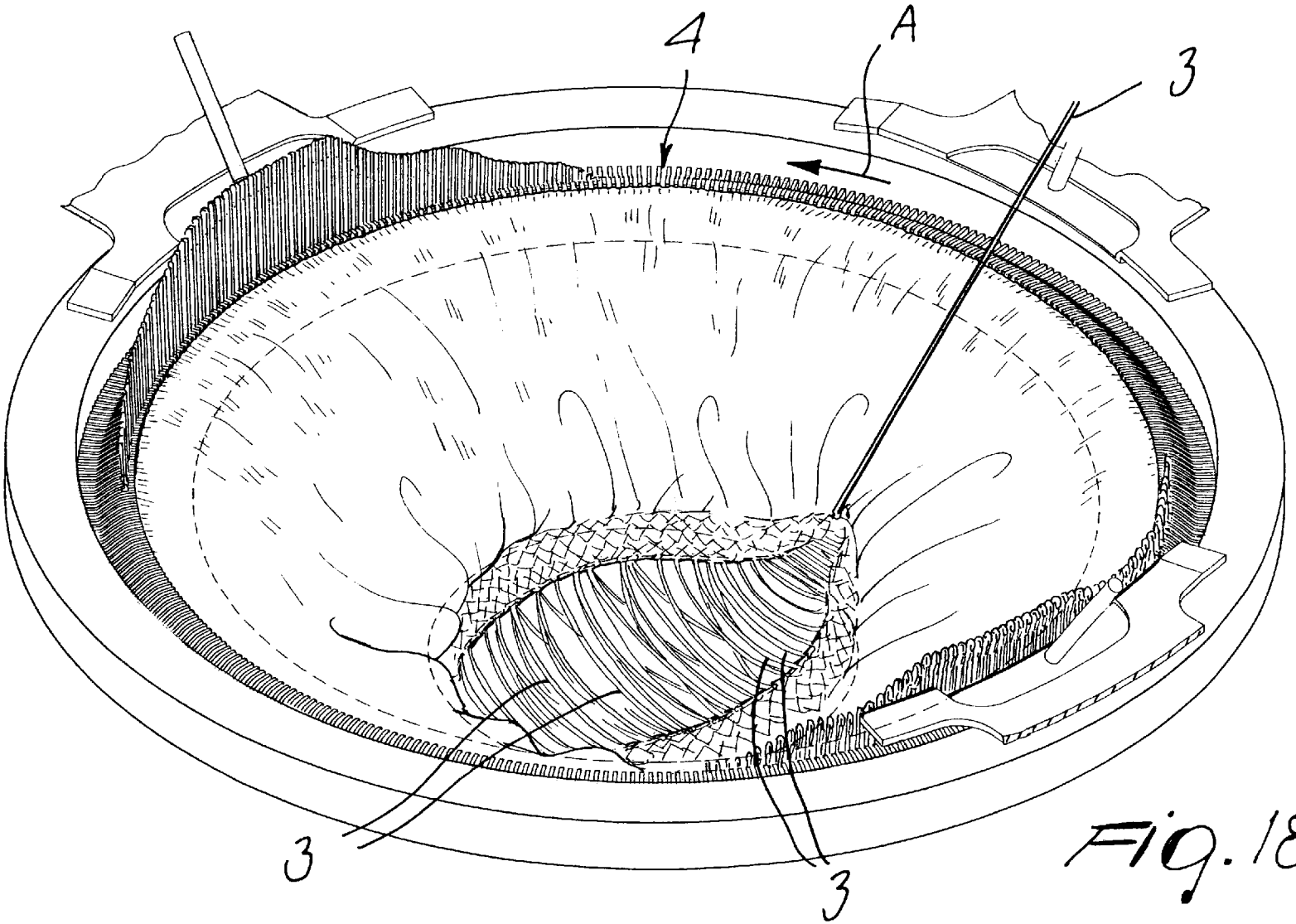
Figure 19:
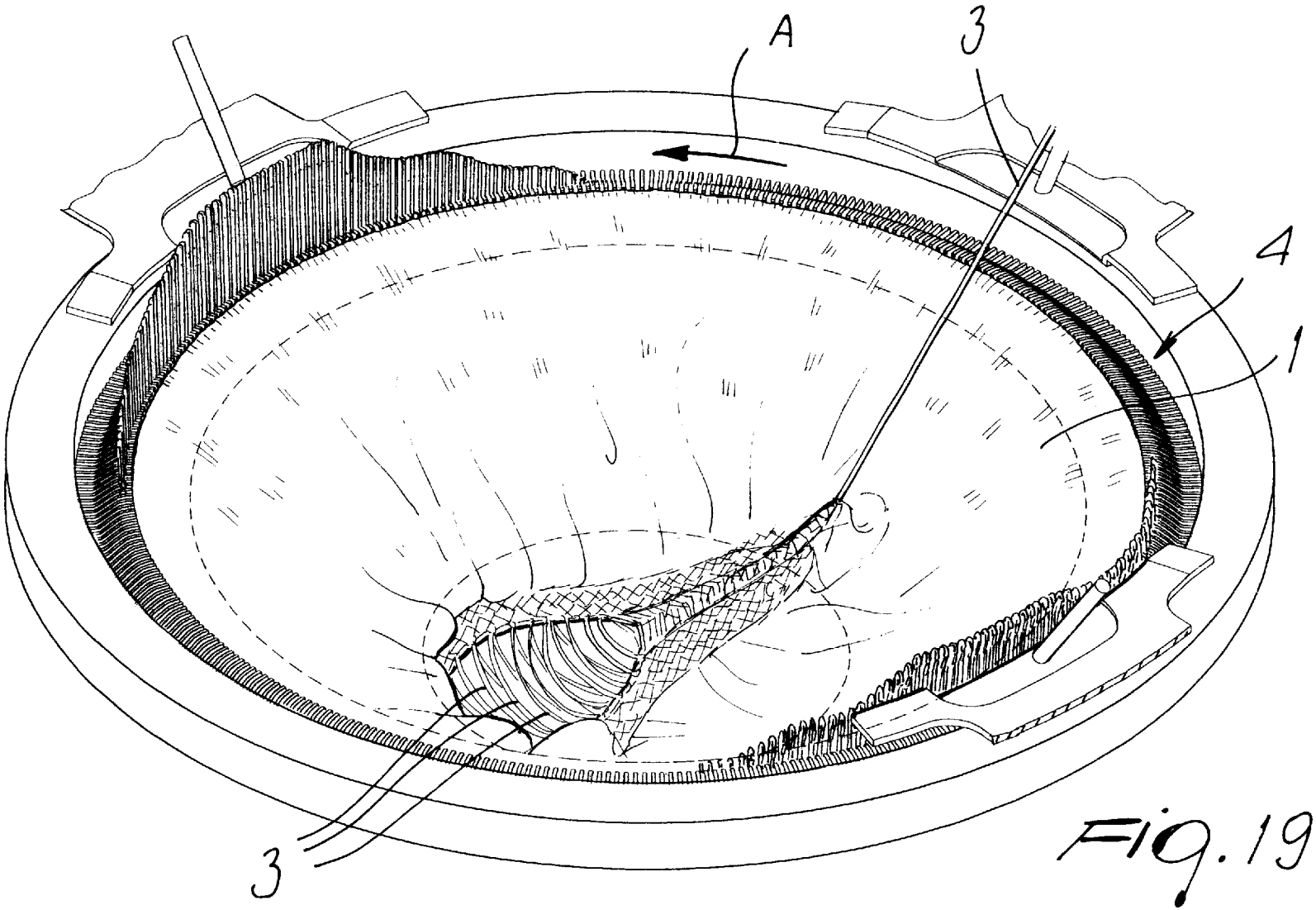
Figure 20:
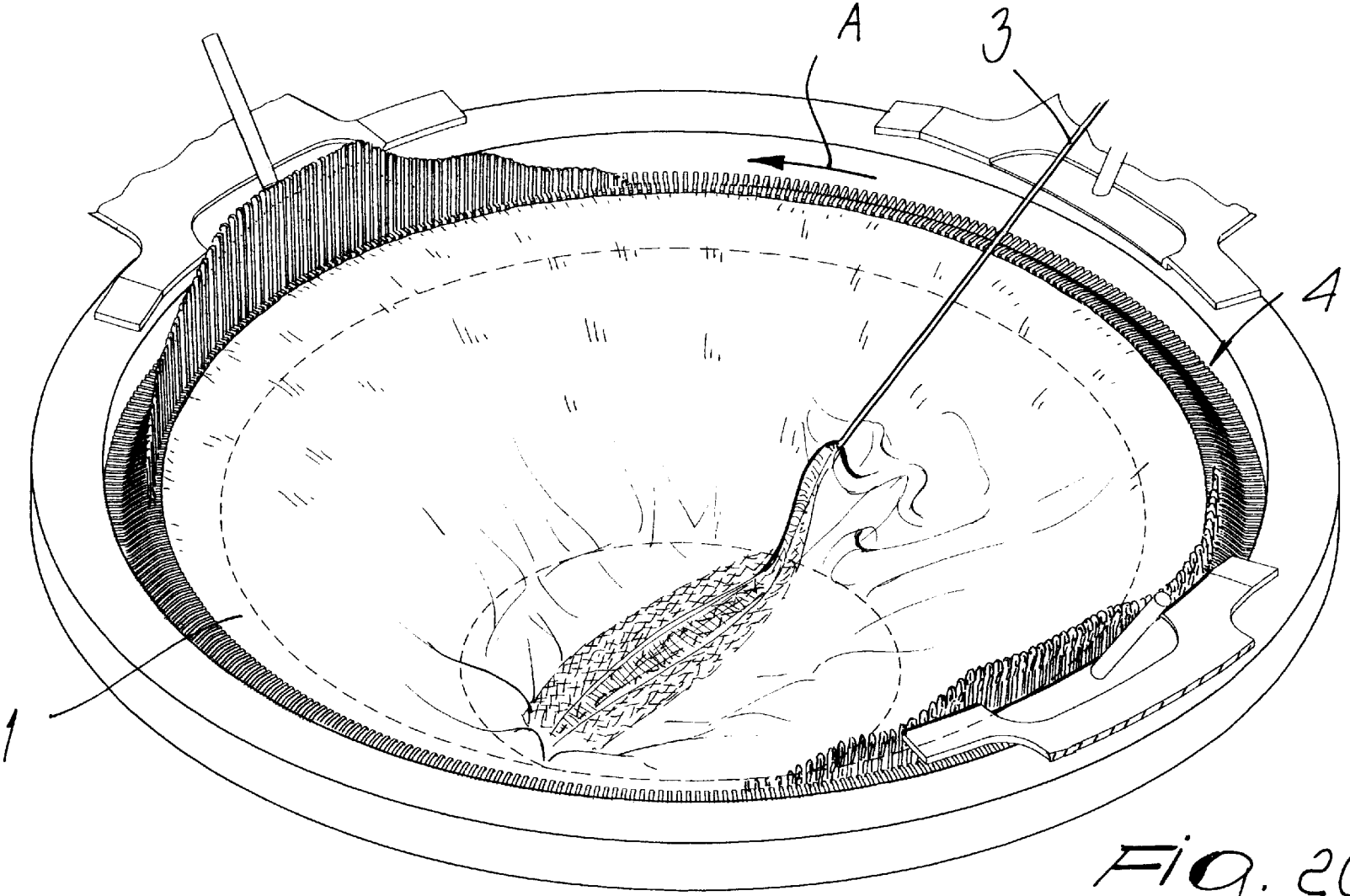

In a fifth step, shown in FIGS. 18 to 20, traction is applied to the closure thread 3 in order to close the initial end of the article 1.

Figure 21:
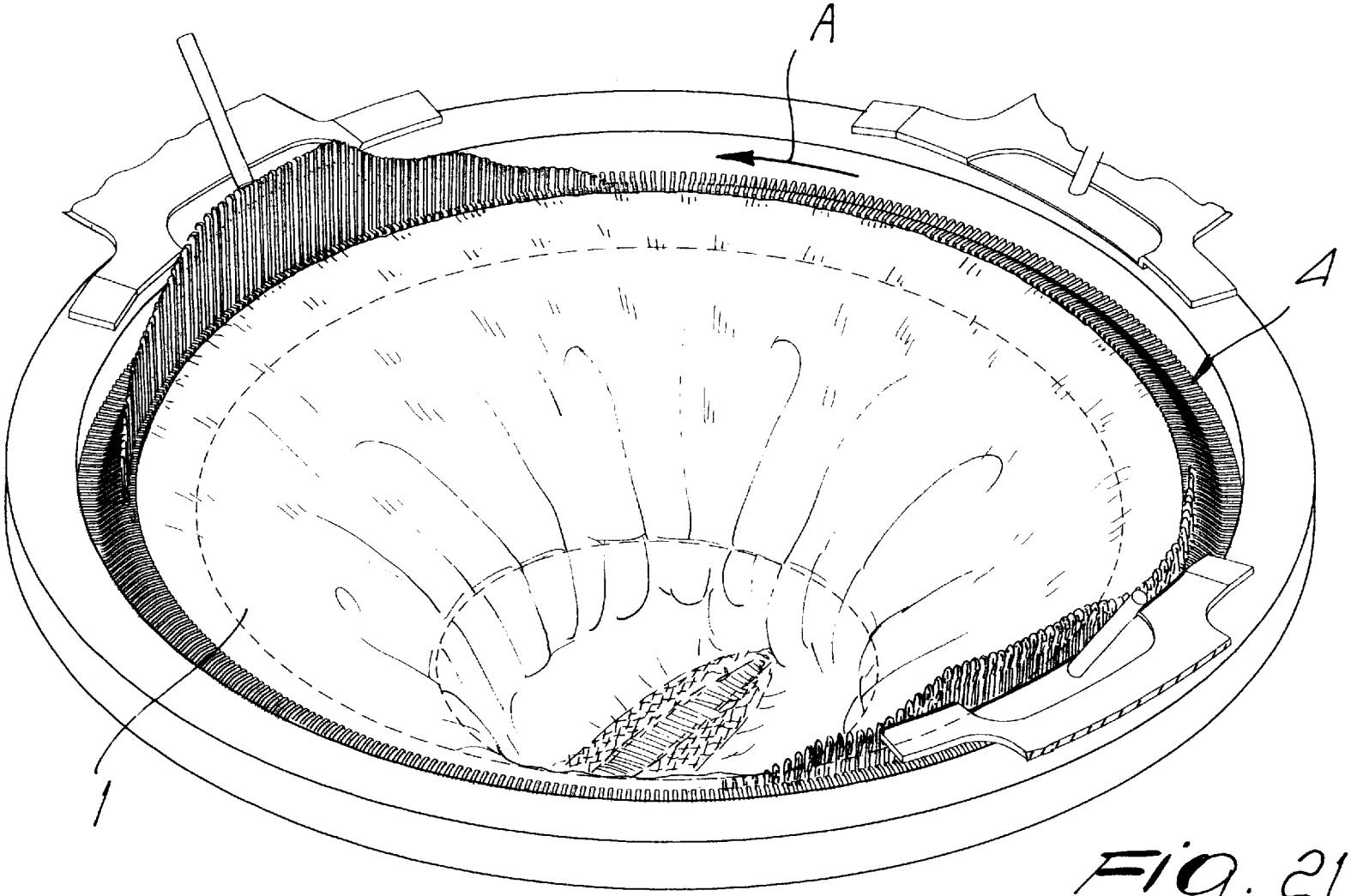

Finally, in a sixth step, shown in FIG. 21, the production of the article 1 is completed in a per se known manner.

The method according to the invention, by way of the particular knitting of the initial portion of the article 1, allows to close said initial end by pulling the closure thread 3 without producing substantial wrinkles at the closure region, which is substantially flat, does not cause discomfort to the user and provides, for the article, a fully satisfactory aesthetic appearance.

An example of practical embodiment of the method according to the invention in the production of a hosiery article 1 on a circular hosiery knitting machine with four hundred needles is described in detail hereinafter merely by way of non-limitative example, without altering the fact that the method according to the invention can be performed also on circular machines that are different from the one shown.

It should be noted that the method according to the invention is performed preferably by actuating the needle cylinder 4 of the machine in a single direction of rotation, indicated by the arrow A, and with a continuous motion.

For better comprehension of the description that follows, it should be noted that the expression "at tuck-stitch height" is used to indicate the lifting of a needle so as to work, at a feed of the machine, so that the needle engages the thread dispensed at said feed without releasing the loop of knitting possibly formed in a preceding step under the latch of the needle.

The expression "at drop-stitch height" instead designates the lifting of a needle so as to work, at a feed of the machine, so that the needle engages the thread dispensed at said feed, dropping below its latch any loop of knitting possibly formed in a preceding step.

The hosiery article 1 is produced starting from its end (toe) to be closed.

Knitting starts by providing, by means of a suitable thread guide 10, the closure thread 3 to a set of contiguous needles so as to form the retention knot 2.

Figure 1:
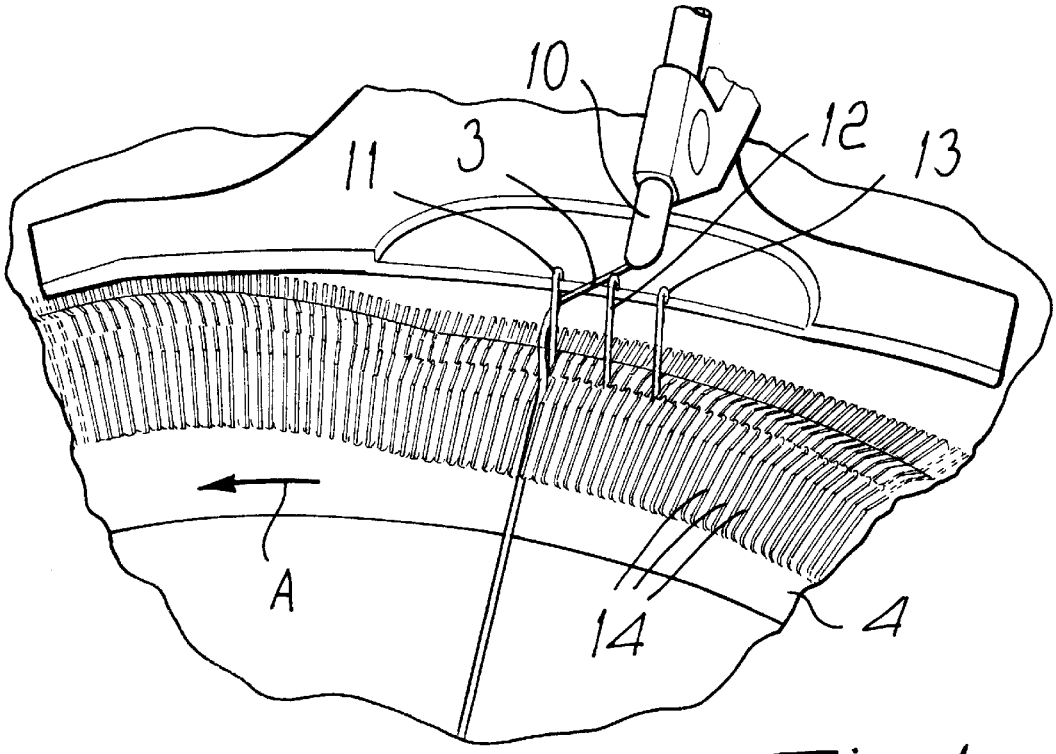
FIGS. 1 to 21 are schematic perspective views showing the sequence of the steps of the method according to the invention in the production of a tubular knitted article, particularly a hosiery article, which is closed at one end.
Figure 2:
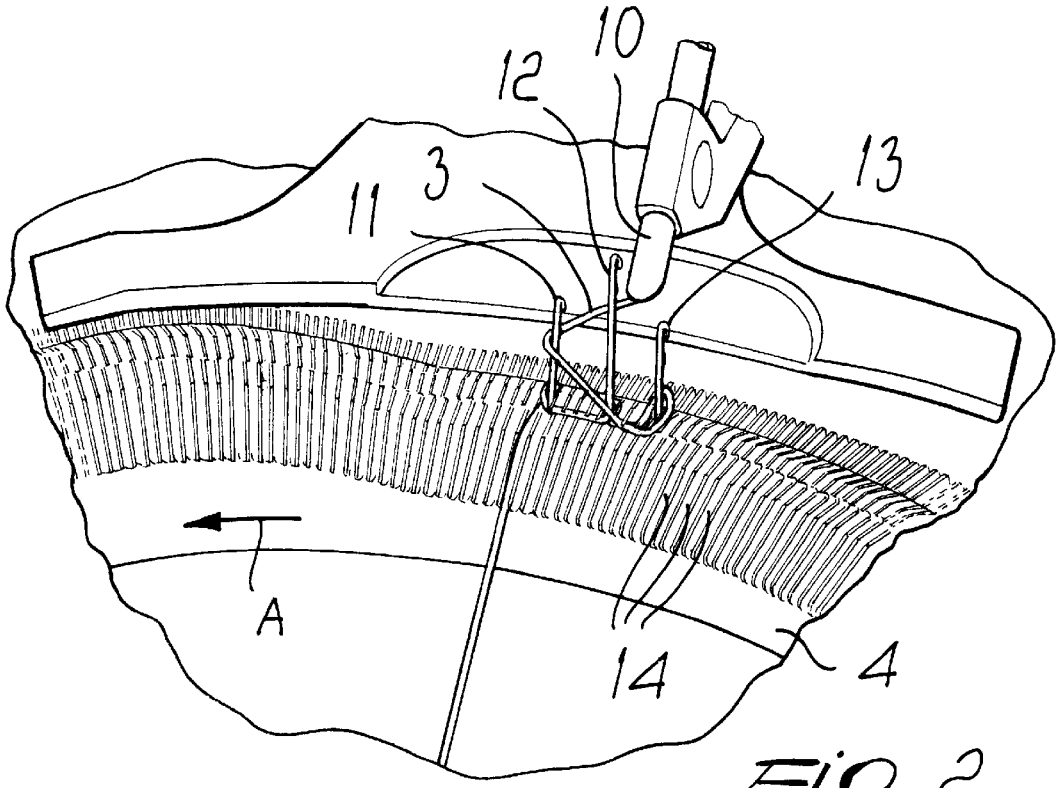
Figure 3:
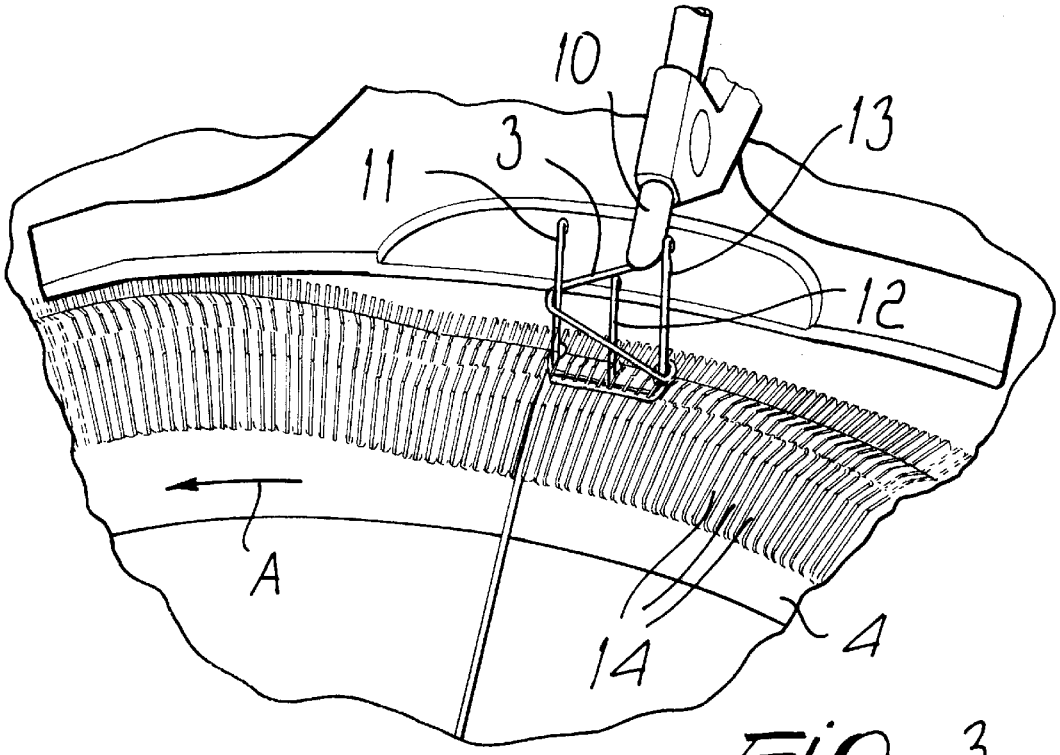
Figure 4:
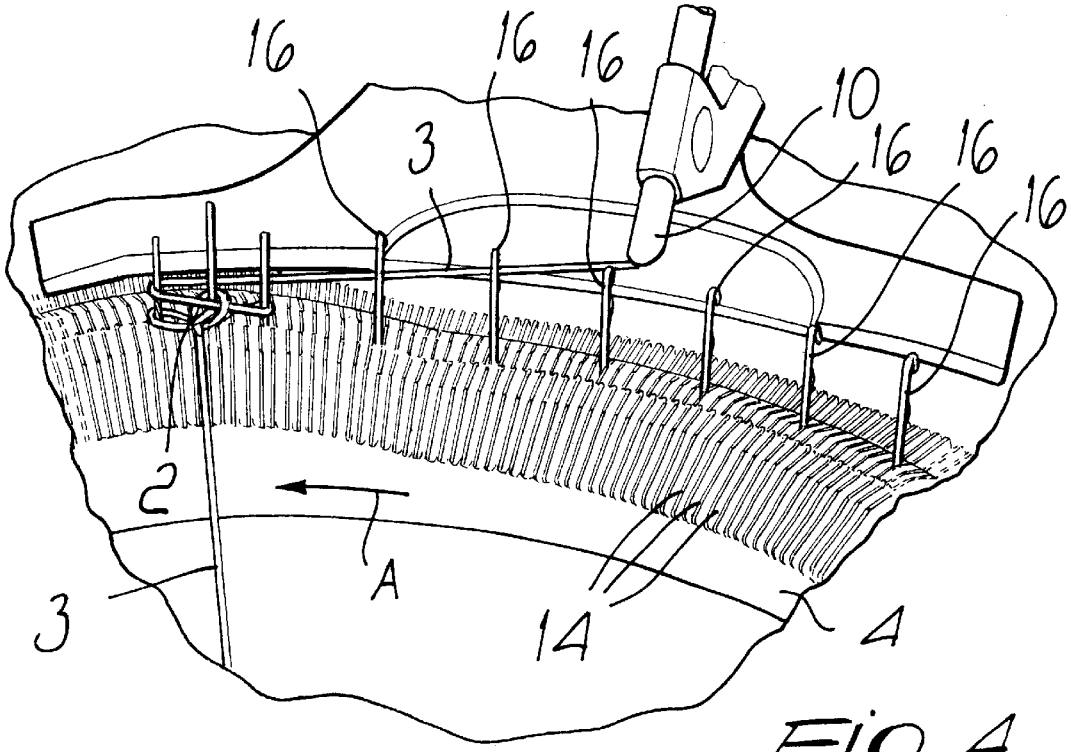
Figure 5:
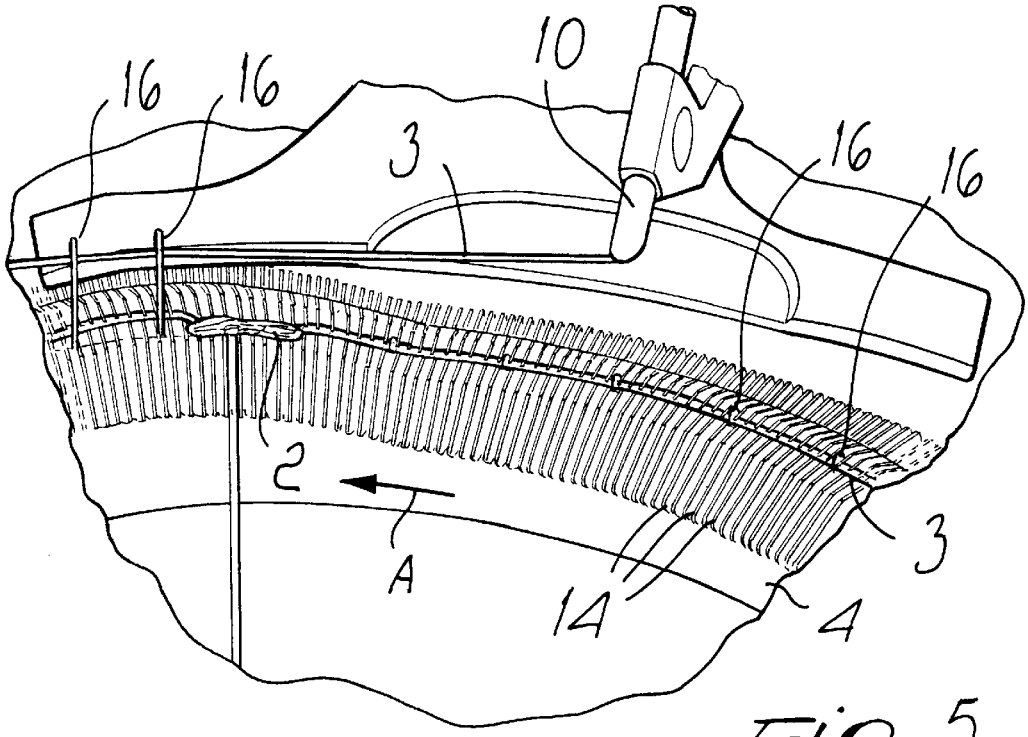
Figure 6:
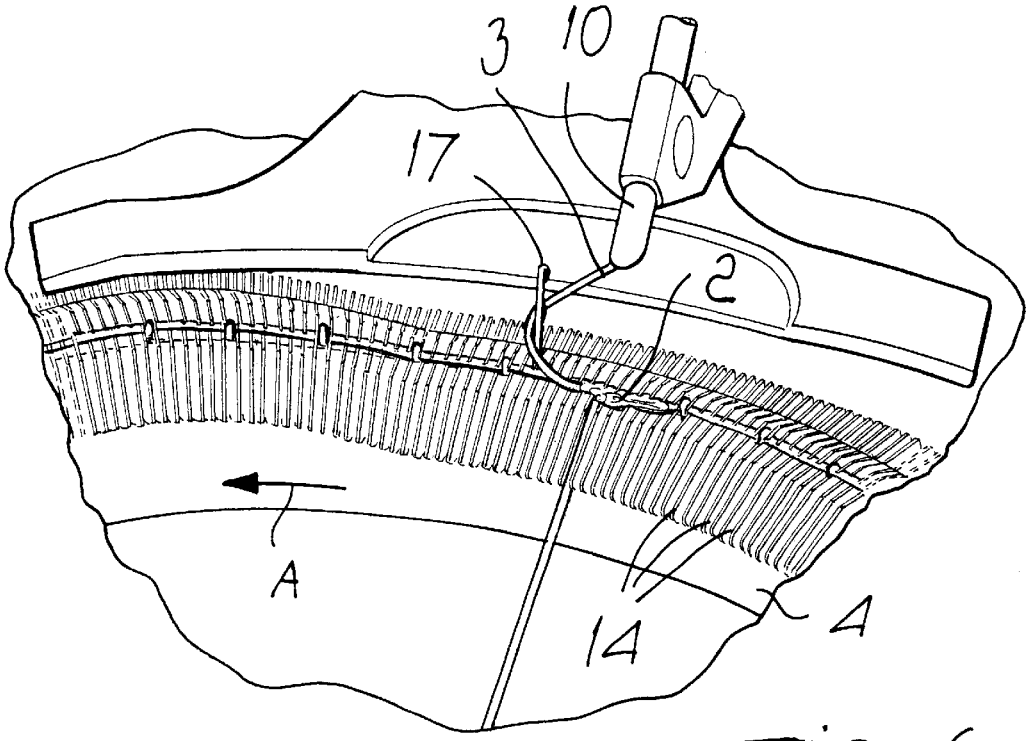
Figure 7:
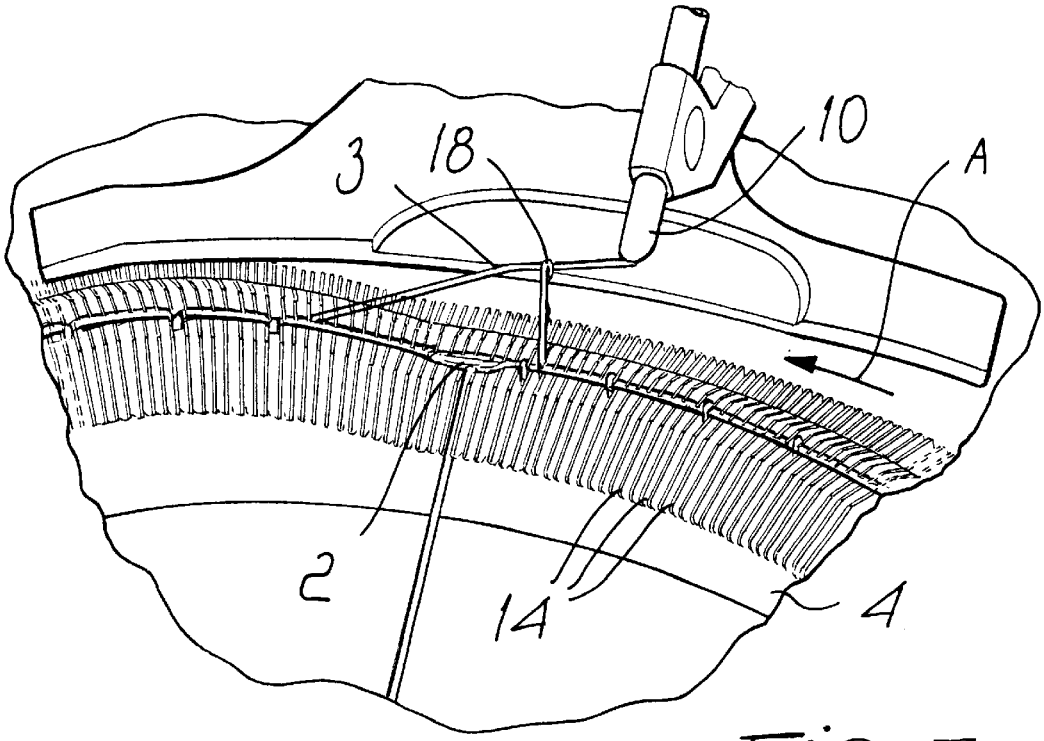
Figure 8:
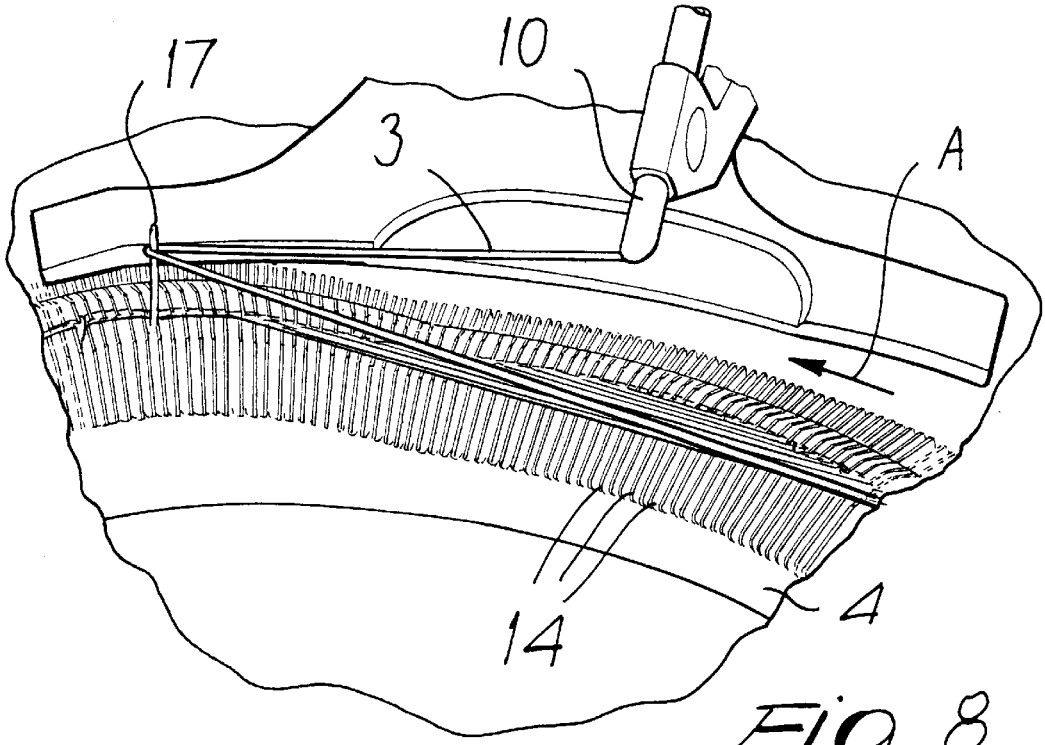
Figure 9:
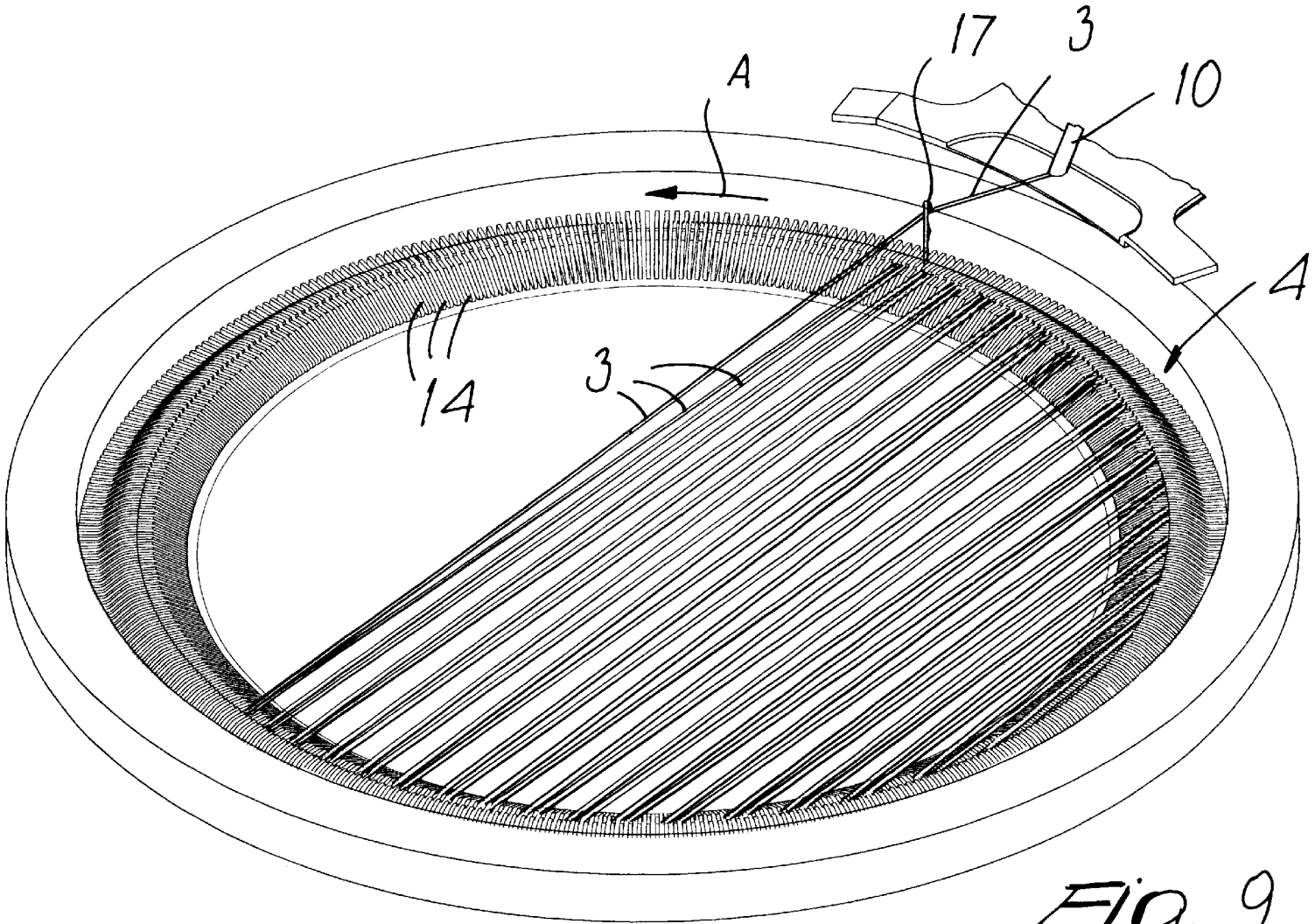
Figure 10:
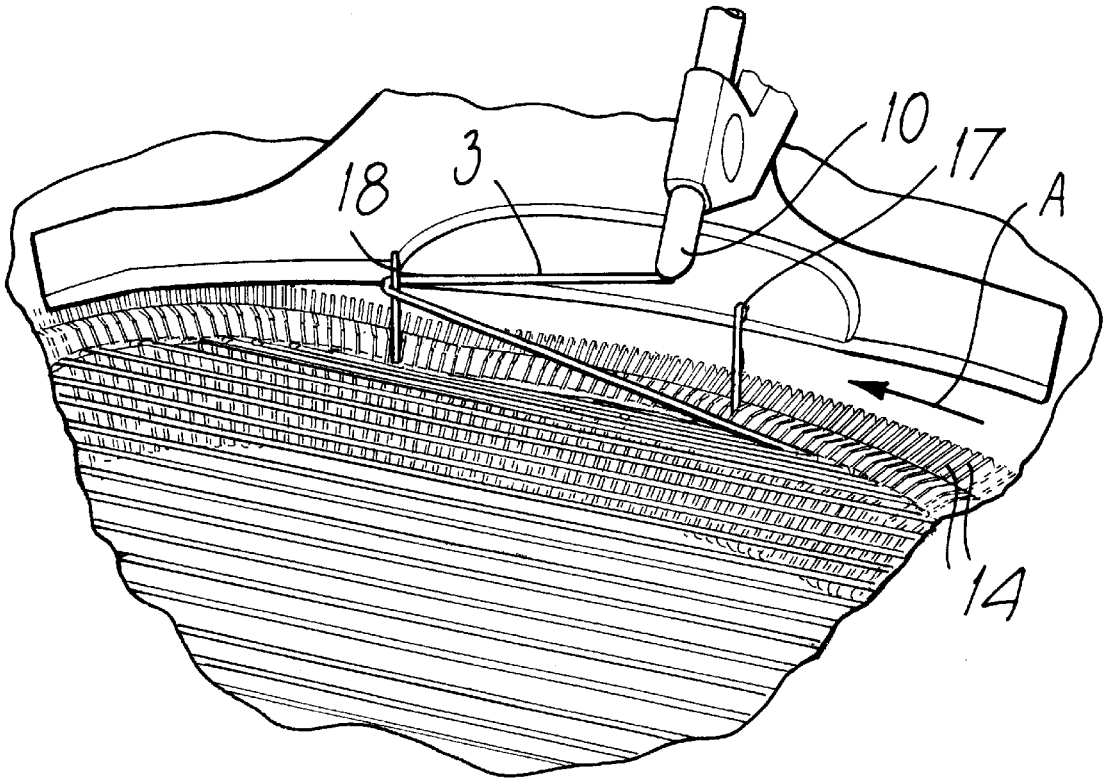
Figure 11:
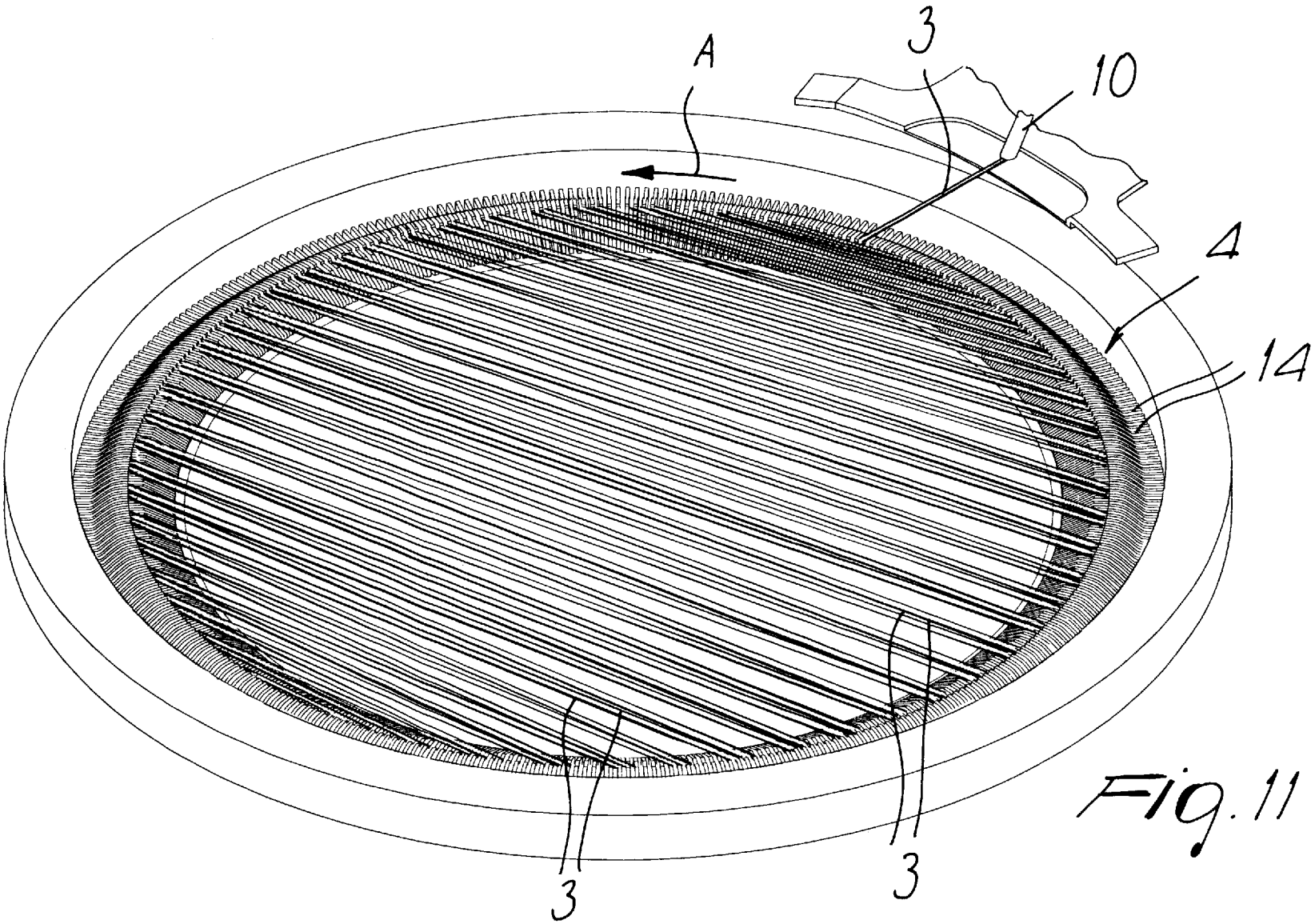
Figure 12:
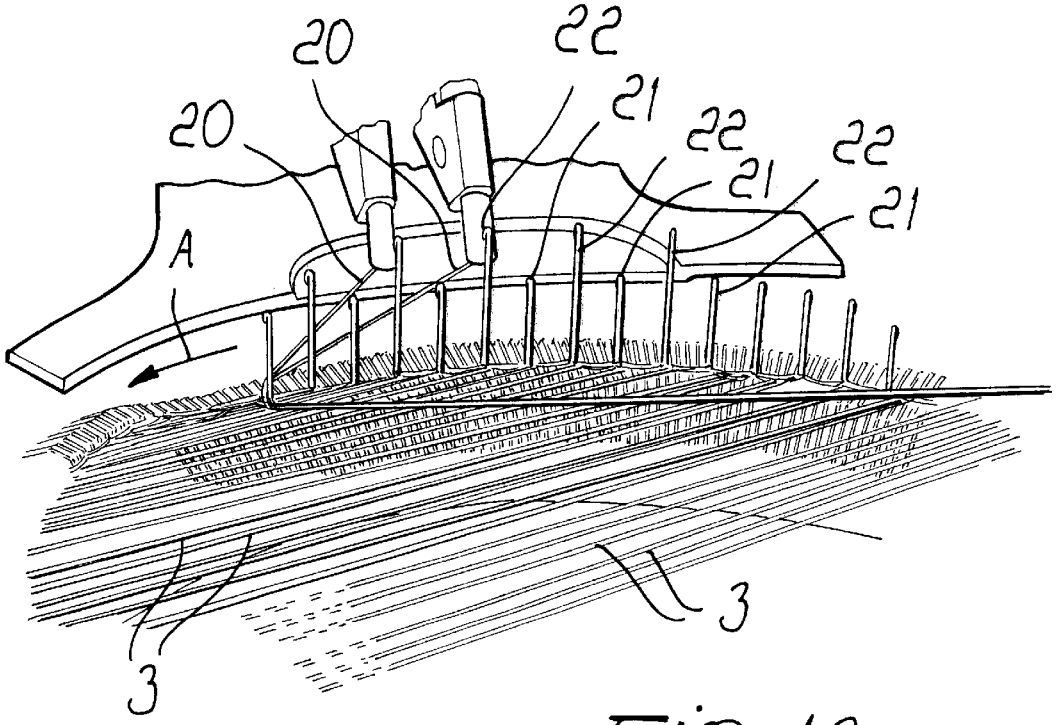

Said retention knot 2 is formed by using three needles, designated by the reference numerals 11, 12 and 13, of a set of nine contiguous needles, in which the first needle 11, the fifth needle 12 and the ninth needle 13 are moved to work at the feed where the thread guide 10 is located. During the first turn of the needle cylinder 4 about its own axis, the closure thread 3 is fed to the three needles 11, 12 and 13, which are raised, at the feed being considered, at the tuck-stitch height (FIG. 1). At the second turn of the needle cylinder 4, the closure thread 3 is fed to the same three needles 11, 12 and 13, which are raised respectively as follows: the needle 11 is raised to the tuck-stitch height, the needle 12 is raised to the drop-stitch height, and the needle 13 is raised to the tuck-stitch height (FIG. 2). At the third turn of the needle cylinder 4, the closure thread 3 is again fed to the needles 11, 12 and 13, which are raised respectively as follows: the needle 11 is raised to the drop-stitch height, the needle 12 is raised to the tuck-stitch height, the needle 13 is raised to the drop-stitch height (FIG. 3). During these three turns of the needle cylinder 4, the needles that are arranged between the active needles 11, 12 and 13 are kept inactive so that their beak lies below the knockover sinkers 14.

During the completion of the third turn of the needle cylinder 4 (FIGS. 4 and 5), mutually spaced needles 16 are moved to work at the tuck-stitch height, at the feed or drop where the closure thread 3 is dispensed, and are fed with said closure thread 3; said needles 16 are raised from each other, at the feed where the closure thread 3 is dispensed, at tuck-stitch height so as to perform woven held-stitch knitting. Preferably, this knitting is performed in 1:7 selection, i.e., by moving to knit, at the feed where the closure thread 3 is fed, one needle 16 every eight contiguous needles.

In the second step, at each turn of the needle cylinder 4 one needle 17 to the left (FIG. 6) and, at the next turn, one needle 18 to the right are selected in each instance and moved to knit at the tuck-stitch height, preferably with a 1:7 selection, lifting the selected needles to the tuck-stitch height level in order to grip the closure thread 3 dispensed at the feed used in the preceding step. In this manner, the closure thread 3 is applied flat over the entire needle cylinder 4 and is engaged alternately in an upward region by needles 17 and 18; respectively, one needle 17 lies on one side of an imaginary central plane that passes through the axis 4*a* of the needle cylinder 4 and through a central region of the set of needles used to form the initial knot 2 of the closure thread 3; the other needle lies on the other side of said imaginary central plane (FIGS. 7 to 11).

At this point (third step), the feeding of the closure thread 3 is interrupted.

In the fourth step, a few rows of knitting are formed with needle selections that change starting from one needle, for example the second one, adjacent to the last needle 18 that engaged the closure thread 3. In particular, by means of another thread or threads 20, dispensed for example at another feed or drop of the machine, a first row of knitting is formed according to a first needle selection in which, for every five contiguous needles, a first needle 21 is moved so as to work at tuck-stitch height, second, third and fourth needles are inactive and are not shown in the figures, with their hook below the level of the knockover sinkers 14, and a fifth needle 22 works at drop-stitch height (FIG. 12), and a second row of knitting is formed with a second needle selection in which, with reference to the same five contiguous needles, the first needle 21 is moved so as to work at drop-stitch height, second, third and fourth needles are inactive and have their hook arranged below the level of the knockover sinkers 14, and a fifth needle 22 works at tuck-stitch height.

Figure 13:
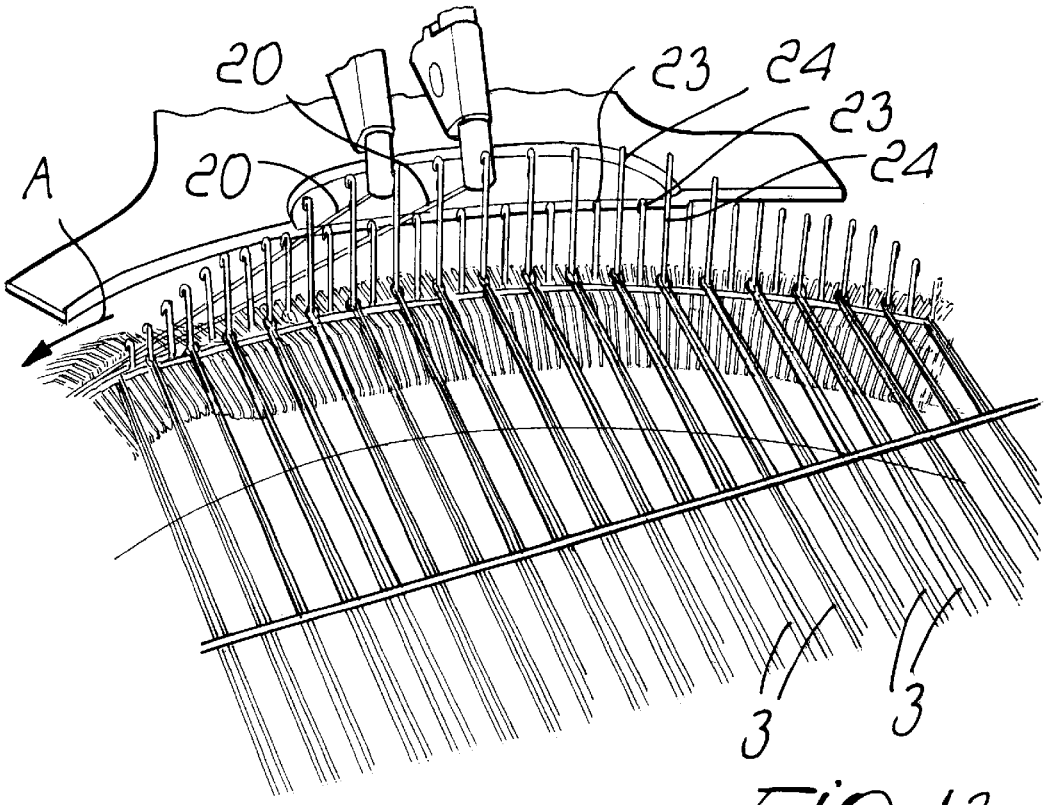
Figure 14:
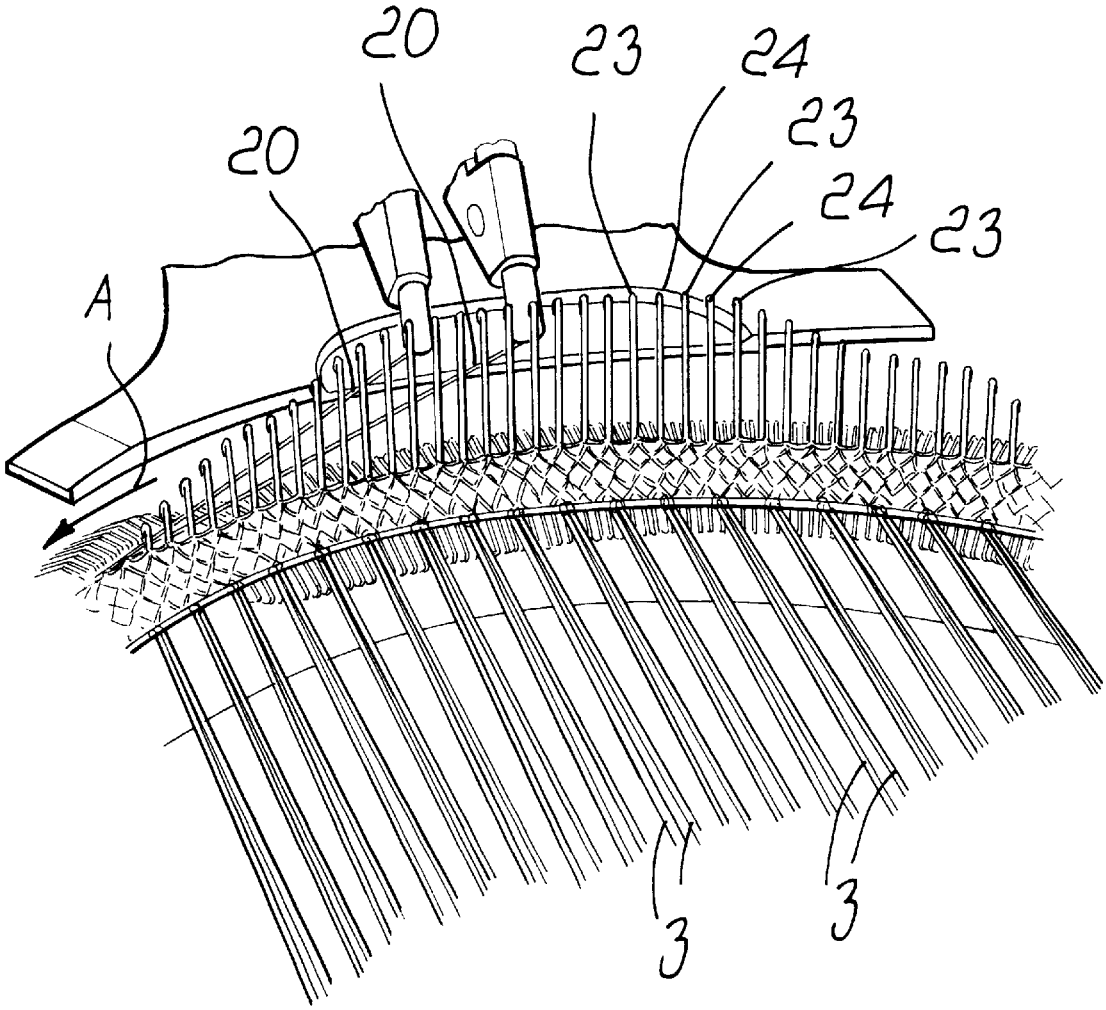

In the fourth step, after forming the second row of knitting, as described, the needles moved so as to work are increased, forming a third row of knitting according to a third needle selection in which, for every three contiguous needles, a first needle 23 is moved so as to work at tuck-stitch height, a second needle is inactive and its hook is arranged below the level of the knockover sinkers 14, and a third needle 24 is moved so as to work at drop-stitch height (FIG. 13). A fourth row of knitting is then formed according to a fourth needle selection, in which, with reference to the same three contiguous needles, the first needle 23 is moved so as to work at drop-stitch height, the second needle is inactive and has its hook below the level of the knockover sinkers 14, and the third needle 24 is moved so as to work at tuck-stitch height, and a fifth row of knitting is formed according to a fifth needle selection in which, with reference to the same three contiguous needles, the first needle 23 is moved so as to work at drop-stitch height, the second needle is inactive and its hook lies below the level of the knockover sinkers 14, and the third needle 24 is moved so as to work at drop-stitch height (FIG. 14).

In the fourth step, after the fifth row of knitting, a few rows of knitting, for example thirty, are formed by repeating several times sequentially the third selection and the fourth selection, interposing an intermediate row performed by means of the fifth selection.

Figure 15:
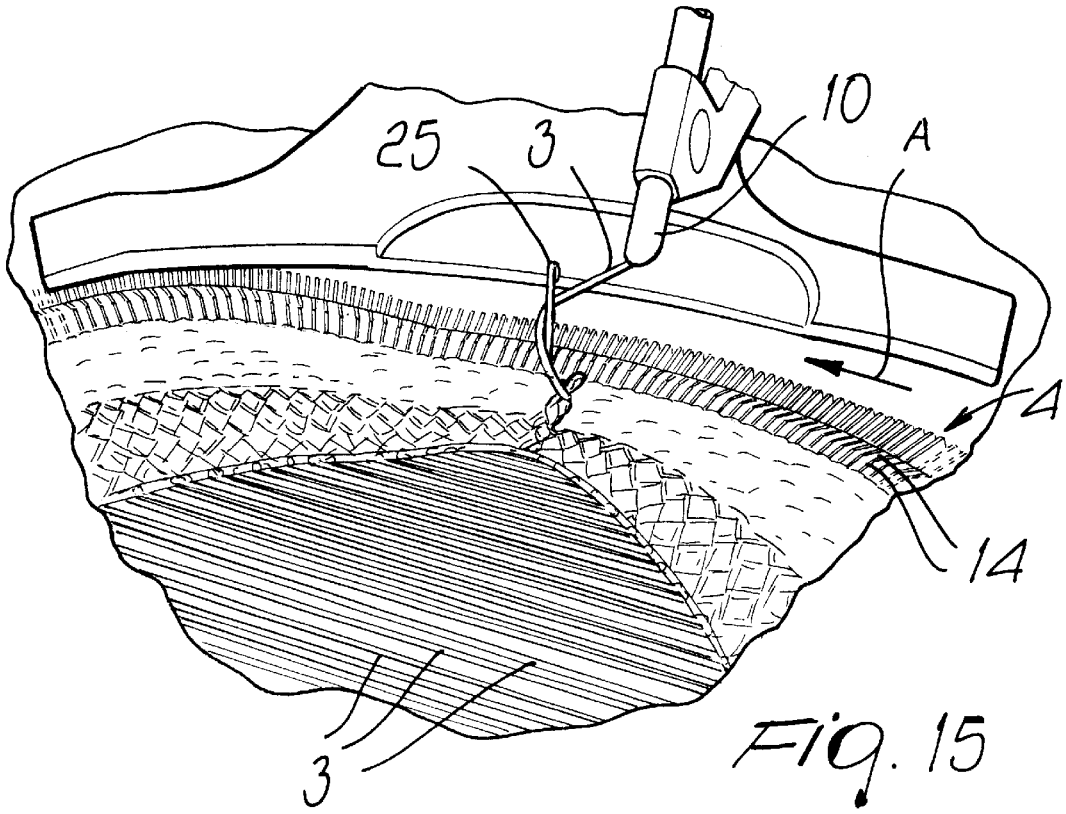
Figure 16:
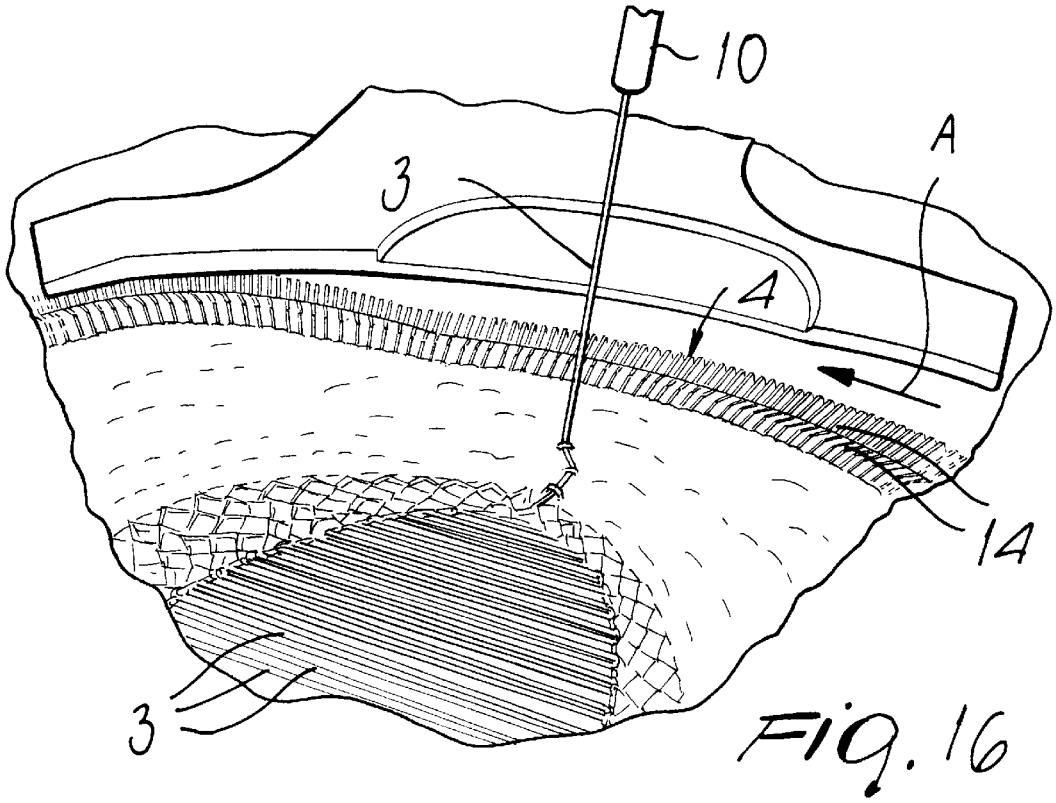
Figure 17:
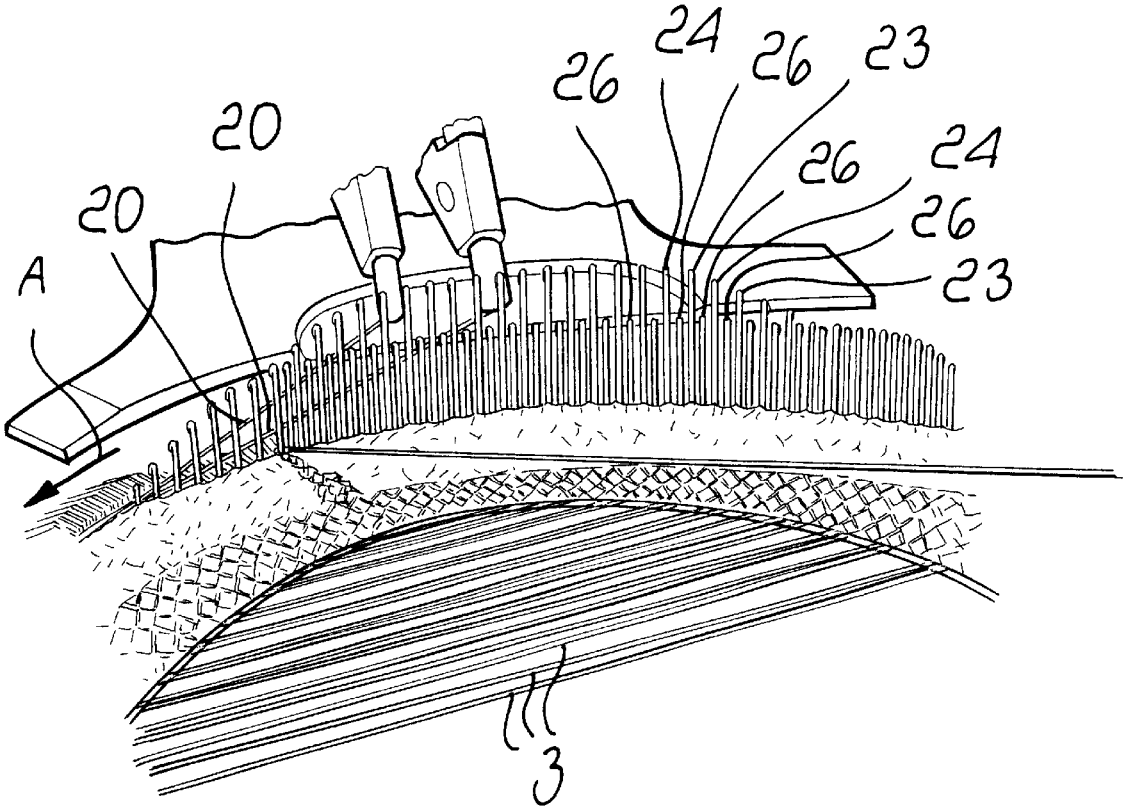

During the production of the article performed by means of the thread or threads 20, the closure thread 3, which runs from the last point of the article where it was looped in with the thread guide 10, is gradually inserted in the knitting being formed, engaging it by means of a needle 25 which is moved so as to work at the feed where the closure thread 3 is dispensed once every three or four turns of the needle cylinder 4, so that the closure thread 3 is inserted partly in the knitting formed during the fourth step (FIGS. 15 and 16).

At the end of this operation, the needles of the machine that had not yet worked are moved so as to work at tuck-stitch height (FIG. 17) in order to increase the diameter of the article (the end of the hosiery article has been completed and the forming of the foot begins).

In the fifth step, the closure thread 3 is subjected to traction, for example by means of a device, not shown, which is located proximate to the upper end of the needle cylinder 4 and which, by taking up the closure thread 3 upstream of the thread guide 10 that dispenses it causes the gradual mutual approach of the loops formed in the second step of the method. In this manner, closure of the initial end of the article (FIGS. 18 to 20) is achieved.

Thanks to the particular knitting performed at the beginning of the formation of the article, said closure is flat, i.e., without wrinkles at the closure region.

Once closure has been completed, the closure thread 3 is cut and the production of the article continues in a per se known manner (FIG. 21).

In practice it has been found that the method according to the invention fully achieves the intended aim, since it allows to produce tubular knitted articles, particularly hosiery articles, which are closed at one end and therefore do not require an additional sewing operation, by means of a circular machine, even with a high gauge, achieving a wrinkle-free closure that does not cause discomfort to the user and is fully satisfactory from an aesthetic standpoint.

Another advantage of the method according to the invention is that it allows to produce tubular articles that are closed at an axial end with a continuous actuation about its own axis of the needle cylinder of the machine, thus allowing to obtain tubular articles that are closed at one end without compromising excessively the productivity of the machine used.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2002A000365 from which this application claims priority are incorporated herein by reference.

What is claimed is:

1. A method for producing a hosiery article, which is closed at one end, without a seam, with a circular machine including at least one needle cylinder, needles with hooks, weave feeding, knockover sinkers, comprising:

a first step, in which the knitting of the article is started from an end to be closed, forming a retention knot for retaining a closure thread by way of a set of contiguous needles;

a second step, in which said closure thread is included in the weave, feeding it to a preset number of needles so that it mutually connects needles that are arranged opposite with respect to an imaginary central plane that passes through an axis of the needle cylinder of the machine and through a central region of said set of contiguous needles;

a third step, in which the feeding of said closure thread to the needles of the machine is interrupted;

a fourth step, in which a few rows of knitting are formed by using another thread or threads and at least part of the needles of the machine;

a fifth step, in which traction is applied to said closure thread in order to close the initial end of the article;

a sixth step, in which the production of the article is completed.

2. The method of claim 1, wherein during operation from said first step to said sixth step, the needle cylinder of the machine is actuated with a continuous rotary motion about the axis thereof.

3. The method of claim 2, wherein during said fourth step said closure thread is inserted in some of the stitches formed in said fourth step.

4. The method of claim 1, wherein said retention knot is produced by way of three needles of said set of contiguous needles by feeding, during a first turn of the needle cylinder, said closure thread to said three needles raised at tuck-stitch height, repeating the same feeding of the closure thread at a second turn of the needle cylinder to the same three needles, raised respectively to tuck-stitch height, to drop-stitch height and to tuck-stitch height, and feeding the closure thread at a third turn of the needle cylinder to the same three needles, which are raised respectively to drop-stitch height, to tuck-stitch height and to drop-stitch height; during said three turns of the needle cylinder, the needles arranged between said three active needles being kept inactive with their hook below the knockover sinkers.

5. The method of claim 4, wherein said set of contiguous needles comprises nine needles, of which the first, fifth and ninth are moved so as to work in order to form said retention knot.

6. The method of claim 5, wherein upon completion of said third turn of the needle cylinder, mutually spaced needles are moved so as to work at tuck-stitch height and are fed with said closure thread in order to form woven tuck-stitch knitting.

7. The method of claim 6, wherein upon completion of said third turn of the needle cylinder, needles at tuck-stitch height are moved so as to work at tuck-stitch height and are fed with said closure thread, forming woven knitting with 1:7 selection.

8. The method of claim 1, wherein during said second step, at each turn of the needle cylinder, one needle to the left and, at a following turn, one needle to the right of said set of contiguous needles is selected in each instance and moved so as to work at tuck-stitch height, according to a selection that affects only part of the needles of the machine.

9. The method-of claim 8, wherein during said second step, at each turn of the needle cylinder, one needle to the left and, at a following turn, one needle to the right of said set of contiguous needles is selected in each instance and moved so as to work at tuck-stitch height according to a 1:7 selection.

10. The method of claim 1, wherein during said fourth step rows of knitting with varied needle selections are alternated.

11. The method of claim 10, wherein during said fourth step a first row of knitting is formed according to a first needle selection in which, for every five contiguous needles, a first needle is moved so as to work at tuck-stitch height, second, fourth and fourth needles are inactive, with their hook below the level of the knockover sinkers, and a fifth needle works at drop-stitch height, and a second row of knitting is formed according to a second needle selection in which, with reference to the same five contiguous needles, a first needle is moved so as to work at drop-stitch height, second, third and fourth needles are inactive, with their hook under the level of the knockover sinkers, and a fifth needle works at tuck-stitch height.

12. The method of claim 11, wherein during said fourth step, after forming said second row of knitting, the needles moved so as to work are increased, forming a third row of knitting according to a third needle selection in which, for every three contiguous needles, a first needle is moved so as to work at tuck-stitch height, a second needle is inactive, with its hook below the level of the knockover sinkers, and a third needle is moved so as to work at drop-stitch height, forming a fourth row of knitting according to a fourth needle selection in which, with reference to the same three contiguous needles, the first needle is moved to work at drop-stitch height, the second needle is inactive, with its hook below the level of the knockover sinkers, and the third needle is moved so as to work at tuck-stitch height, and forming a fifth row of knitting according to a fifth needle selection in which, with reference to said three contiguous needles, the first needle is moved so as to knit at drop-stitch height, the second needle is inactive, with its hook below the level of the knockover sinkers, and the third needle is moved so as to work at drop-stitch height.

13. The method of claim 12, wherein during said fourth step, after said fifth row, a few rows of knitting are formed by repeating several times, in sequence, said third selection and said fourth selection with an intermediate row produced by way of said fifth selection.

14. The method of claim 13, wherein during said fourth step, after forming said few rows, needles that have not worked yet are moved so as to work at tuck-stitch height.

15. A hosiery article, provided according to claim 1.

* * * * *